US005570798A

United States Patent [19]

Hayashida et al.

[11] Patent Number: 5,570,798

[45] Date of Patent: Nov. 5, 1996

[54] CONTAINER OPENING/CLOSING DEVICE

[75] Inventors: Mitsuharu Hayashida; Yoshihiro Miyata, both of Nara-ken, Japan

[73] Assignee: Mikasa Industry Co., Inc., Nara-ken, Japan

[21] Appl. No.: 439,777

[22] Filed: May 12, 1995

[30] Foreign Application Priority Data

May 17, 1994 [JP] Japan ..... 6-102470

[51] Int. Cl.[6] ..... B65D 41/34

[52] U.S. Cl. ..... 215/252

[58] Field of Search ..... 215/252

[56] References Cited

U.S. PATENT DOCUMENTS

| | | | |
|---|---|---|---|
| 4,458,821 | 7/1984 | Ostrowsky | 215/252 |
| 4,458,822 | 7/1984 | Ostrowsky | 215/252 |
| 4,478,343 | 10/1984 | Ostrowsky | 215/252 |
| 5,282,540 | 2/1994 | Beck | 215/252 |
| 5,400,913 | 3/1995 | Kelly | 215/252 |

FOREIGN PATENT DOCUMENTS

| | | | |
|---|---|---|---|
| 94/14673 | 7/1994 | WIPO | 215/252 |

*Primary Examiner*—Stephen K. Cronin

*Attorney, Agent, or Firm*—Armstrong, Westerman, Hattori, McLeland & Naughton

[57] ABSTRACT

A cap made of synthetic resin coming into mesh with a mouth of a container is provided, wherein the cap comprises a tubular member made of synthetic resin, a ring provided integrally with a lower end of the tubular member through easily frangible joint pieces, a multiplicity of engagement members formed to extend obliquely upward from an inner lower end of the ring and to have a uniform thickness as a whole, the engagement members being each inclined along both sides thereof so as to spread toward their upper end and project radially inward to have an arc-shaped bulged portion, junctions at which opposite upper side ends of the adjacent engagement members are integrally connected to each other, and thin films formed to cover areas defined by the ring and the adjacent engagement members, and the container has a mouth provided with a screw-shaped groove cooperating with the cap and an annular projection formed below the screw-shaped groove and engaging the engagement members. There is also provided a cap wherein opposite upper side ends of the adjacent members are not connected to each other, and wherein the thin films are formed to cover areas defined between the ring and the adjacent engagement members. An embrittled line is formed to extend vertically across the ring, the engagement member, and/or the thin film.

4 Claims, 7 Drawing Sheets

CONTAINER OPENING/CLOSING DEVICE

BACKGROUND OF THE INVENTION

1. Field of the Invention

The present invention relates to a container opening/closing device, and more particularly to a container opening/closing device with a pilfer-proof function.

2. Description of the Related Arts

Various types of container opening/closing devices with a pilfer-proof function have heretofore been known. Examples of related patents and utility models publicized in Japan are below:

Japanese Patent Publication No. 5-55386

Japanese Utility Model Publication No. 57-9240

Japanese Utility Model Laid-Open No. 56-125848

Japanese Utility Model Laid-Open No. 62-11745

These known container opening/closing devices have a structure substantially common to all of them. By way of example, one of the known devices disclosed in Japanese Patent Publication No. 5-55386 is formed as shown in FIGS. 16 and 17. In the figures, denoted by reference numeral 51 is a container mouth, and 52 is a screw cap having screws (not shown) for meshing with the mouth 51. The screw cap 52 has a skirt 53 provided with a band 55 through an easily frangible bridge 54. The band 55 is connected to a stop ring 56 through a hinge portion 57 therebetween, the stop ring 56 being bent at the hinge portion 57 to locate inside the band 55. The stop ring 56 is formed to have a thickness increasing toward its upper end. An upper bead 58 and a lower bead 59 are formed around the mouth 51.

In the container opening/closing device of the above structure, when the screw cap 52 is fitted to the mouth 51, the stop ring 56 descends and rides over the upper bead 58 while elastically deforming, and then deflects under the upper bead 58 upon restoration from its elastically deformed state. As a result, the stop ring 56 vertically engages the upper bead 58. If a pilferer, i.e., a person other than the genuine consumer, unscrews the screw cap 52 to make it open, because the band 55 cannot move up owing to the tight engagement with the upper bead 58, the bridge 54 is torn and the band 55 is moved downward, indicating that the container has been cheatingly opened.

The foregoing type of container opening/closing device with a pilfer-proof function generally, however, has common problems indicated below.

The stop ring 56 is required to have elasticity or pliability because of its need to deflect in the radial direction when it rides downwardly over the upper bead 58, but to have rigidity when the screw cap 52 is unscrewed and removed by the consumer. The reason is that when the consumer tears the bridge 54, to make the cap open, the stop ring 56, to be sufficiently pliable to be elastically deformed, has difficulty in producing a reaction force for tearing the bridge 54. Thus, the bridge 54 will not easily tear, rendering the consumer to feel embarrassed or unpleasant. It is therefore preferable for the stop ring 56 to have such a degree of rigidity that the bridge 54 is torn in a snap as soon as the screw cap 52 is unscrewed. Stated otherwise, the stop ring 56 faces the problem that it must satisfy the contradictory requirements of pliability and rigidity.

In view of the above, the stop ring 56 disclosed in the above-cited Japanese Patent Publication No. 5-55386 is formed, as shown, to have a thickness that increases toward its upper end to provide a required degree of rigidity, and decreases toward its lower end, i.e., the hinge portion 57 where the thickness is minimized, to provide a required degree of pliability.

But, because of having a thickness decreasing toward its lower end, the stop ring 56 exhibits pliability and its lower portion is elastically deformed when the consumer unscrews the cap. The bridge 54 will not tear while the stop ring 56 continues elastic deformation and is finally torn only after reaching a limit of the elastic deformation. Accordingly, the consumer feels embarrassed or unpleasant at the fact that the bridge 54 will not easily tear although the consumer applies force to the cap for making it open.

Another problem is as follows. The stop ring 56 is formed to extend obliquely downward, though not shown, when the screw cap is molded, and is thereafter inverted or folded back to extend obliquely upward. However, great force is required to invert the stop ring 56 as it can not easily be folded back.

Still another problem is that after the screw cap 52 has been unscrewed and removed, the band 55 still remains around the container mouth 51, resulting in an aesthetically worsened appearance.

With a view to solving the problems as set forth above, an object of the present invention is to provide a container opening/closing device having a component corresponding to the stop ring 56, which portion exhibits pliability so as to be able to elastically deform when a screw cap is fitted over a container, allowing that component to easily ride over a component corresponding to the upper bead 58, but exhibits rigidity when the consumer unscrews the cap to make it open, enabling a component corresponding to the bridge 54 to be immediately torn in a snap.

Another object of the present invention is to provide a container opening/closing device in which, when the component corresponding to the stop ring 56 is folded back after being formed, it can be more easily folded back than the strip ring 56 in the prior art.

Still another object of the present invention is to provide a container opening/closing device in which the component corresponding to the stop ring 56 is adaptable for large variations in size of the container mouth or the screw cap as occurred during manufacture.

Still another object of the present invention is to provide a container opening/closing device in which, after the screw cap has been unscrewed and removed, a component corresponding to the band 55 can be removed so that the container mouth has an aesthetically trim appearance.

SUMMARY OF THE INVENTION

To achieve the above objects, a container opening/closing device of the present invention includes a cap made of synthetic resin, the cap comprising a cap body including a top wall made of synthetic resin and a tubular member formed integrally with the top wall and having a screw-shaped rib formed on an inner circumferential surface thereof; a ring provided integrally with a lower end of the tubular member through easily frangible joint pieces; a multiplicity of engagement members formed to extend obliquely upward from an inner lower end of the ring and to have a uniform thickness throughout, the engagement members being each inclined along both sides thereof so as to spread toward its upper end and project radially inward to have an arc-shaped bulged portion; junctions at which opposite upper side ends of adjacent pairs of the engagement members are integrally connected to each other; and thin films formed to cover areas defined by the inner lower end of the ring and the respective adjacent engagement members, and a container having a mouth provided on an outer circumferential surface thereof with a screw-shaped groove cooperable with the screw-shaped rib and an annular projection for engaging the engagement members in the vertical direction.

In the above container opening/closing device, preferably, an embrittled line is formed to extend continuously vertically across the ring and the engagement member, or the ring, the thin film and the engagement member.

As an alternative, a container opening/closing device of the present invention includes a cap made of synthetic resin, the cap comprising a cap body comprised of a top wall made of synthetic resin and a tubular member formed integrally with the top wall and having a screw-shaped rib formed on an inner circumferential surface thereof; a ring provided integrally with a lower end of the tubular member through easily frangible joint pieces; a multiplicity of engagement members formed to extend obliquely upward from an inner lower end of the ring and to have a uniform thickness throughout, the engagement members being each inclined along both sides thereof so as to spread toward its upper end and projected radially inward to have an arc-shaped bulged portion; and thin films formed to cover areas defined by the inner lower end of the ring and adjacent ones of the engagement members, and a container having a mouth provided in and on an outer circumferential surface thereof with a screw-shaped groove coming into mesh with the screw-shaped rib and an annular projection engaging the engagement members in the vertical direction.

In the above container opening/closing device, preferably, an embrittled line is formed to extend continuously vertically across the ring and the engagement member, or the ring and the thin film, or the ring, the engagement member and the thin film.

In the container opening/closing device of the present invention arranged as set forth above, when the cap is screwed over the mouth of the container, causing the engagement members to ride downwardly over the annular projection around the container mouth, the engagement members formed to extend obliquely upward from the inner lower end of the ring and to project radially inward to have the arc-shaped bulged portions are elastically deformed at the bulged portions by the annular projection and are recessed or pushed back radially outward to be able to smoothly ride downwardly over the annular projection around the container mouth. When the engagement members come into the side below the annular projection after having completely ridden over it, they are allowed in the side below the annular projection to bulge radially inward into the original arc-shape again upon restoration from its elastically deformed state so that the engagement members engage the annular projection in the vertical direction. At this time, since the engagement members are bulged radially inward to have the arc-shaped bulged portions, they can deeply enter under the annular projection. Accordingly, there is no danger that the engagement members may disengage from, or ride over, the annular projection upward when the cap is unscrewed to remove it.

When a proper user, e.g., a genuine consumer, unscrews the cap, the upper edges of the engagement members abut against the underside of the annular projection to push it upward. At this time, the engagement members are bulged radially inward to have an arc-shaped, as viewed from above, providing a high degree of compression strength in the vertical direction, i.e., a high degree of vertical rigidity. Therefore, when the engagement members push up against the annular projection, the resulting reaction force is immediately transmitted to the joint pieces through the ring. As a result, the joint pieces can be immediately torn in a snap without making the consumer feel embarrassed or unpleasant unlike the above-described prior art in which the component corresponding to the joint pieces will not easily tear.

The engagement members basically equally operate regardless of whether the opposite side ends of the adjacent engagement members are connected to each other at the junctions or not. However, in the cap that the opposite side ends of the adjacent engagement members are not connected to each other, the thin films can be more easily elongated when the engagement members ride over the annular projection, so that the riding of the engagement members over the annular projection is facilitated.

The engagement members are formed to extend obliquely downward in injection molding, and then are inverted or folded back to extend obliquely upward. But since the engagement members are each inclined along both sides thereof so as to divergently spread toward the upper end and only the thin film is formed between the adjacent engagement members with their base portions spaced from each other at a distance, i.e., since the engagement members are more apt to bend at the lower end of the ring, they can be folded back by smaller forces than are required for folding back the corresponding components in the prior art.

Further, since the engagement members have the arc-shaped bulged portions projecting radially inward, even if there occur variations in size of the mouth of the container or the cap during manufacture, the bulged portions of the engagement members are elastically deformed radially to absorb the variations so that the cap can be fitted to the container mouth.

Additionally, after removing the cap body, the ring including the engagement members is left around the mouth of the container. However, the ring can be removed from the mouth of the container by tearing it at the embrittled line. The problem that the mouth of the container is aesthetically worsened in its appearance can be hence solved.

DETAILED DESCRIPTION OF THE PREFERRED EMBODIMENTS

Figure 1:
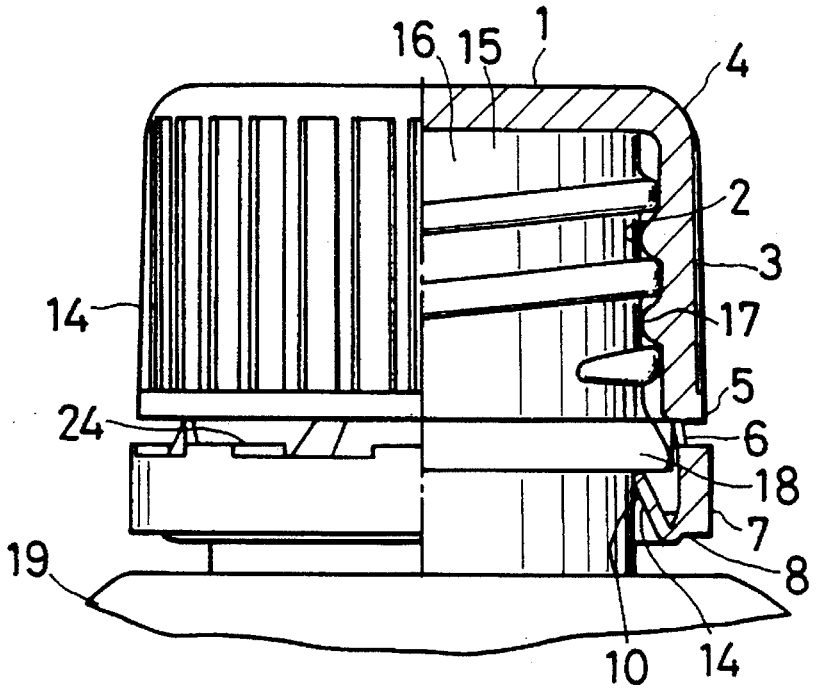
FIG. 1 is a view, partly in section, of a container opening/closing device, the view showing one embodiment of the present invention.

Referring to FIG. 1, denoted by 4, is a cap body made of synthetic resin, e.g., polyethylene or polypropylene, the cap body comprising a circular top wall 1 and a tubular member 3 formed integrally with the top wall 1. A screw-shaped rib 2 is formed on an inner circumferential surface of the tubular member 3.

Figure 2:
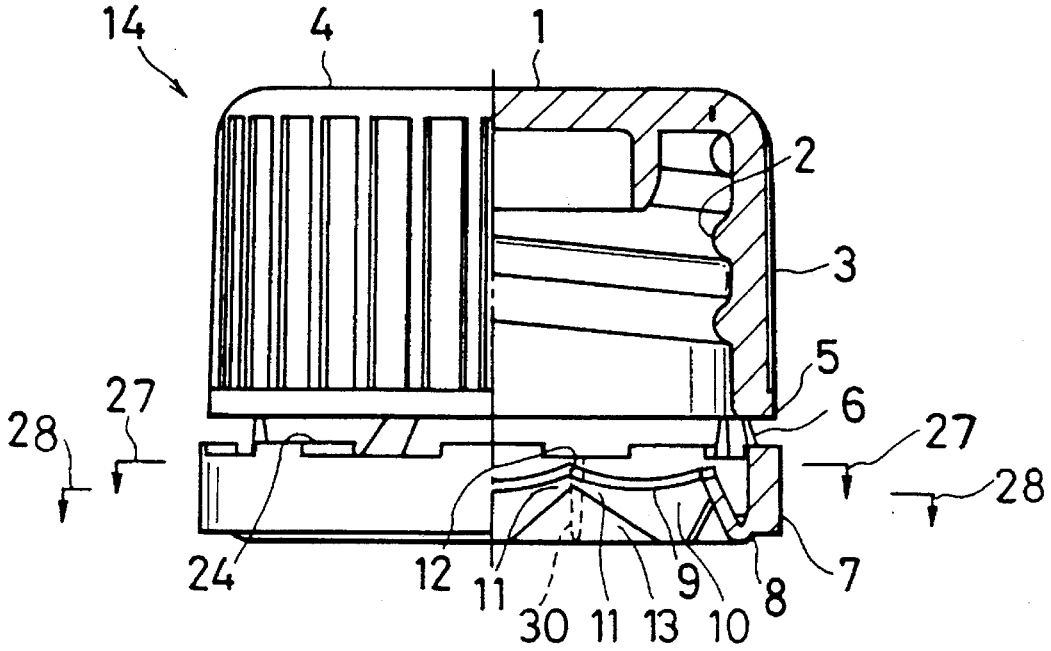
FIG. 2 is a view, partly in section, of a cap of the container opening/closing device shown in FIG. 1.
Figure 3:
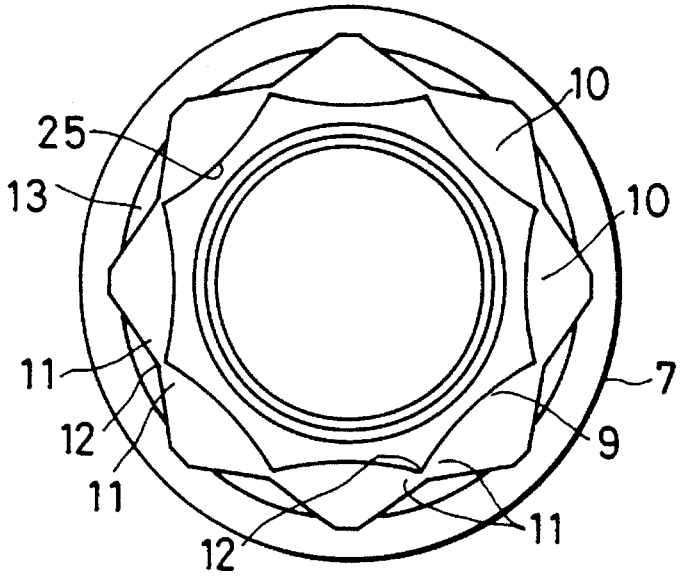
FIG. 3 is a bottom view of the cap of the container opening/closing device shown in FIG. 1.

A ring 7 is provided integrally with a lower end 5 of the tubular member 3 through a plurality of joint pieces 6 which are formed to be easily frangible. A multiplicity of engagement members 10 are formed integrally with and extended obliquely upward from an inner lower end 8 of the ring 7. As seen from FIG. 2, the engagement members 10 are each inclined along both sides thereof so as to spread toward its upper end, have a uniform thickness throughout, and are each bulged radially inward, as indicated by 9, to provide an arc-shaped projecting upper edge. Also, as shown in FIGS. 2 and 3, the adjacent engagement members 10 are formed such that their opposite upper side ends 11, 11 are integrally connected to each other at junctions 12. Thin films 13 are formed integrally with the inner lower end 8 of the ring 7 and the engagement members 10 to cover areas defined by the inner lower end and the adjacent engagement members 10.

The presence of the thin films 13 enables the multiplicity of engagement members 10 of the above arrangement to be released from a mold when the cap body is molded by injection. Numeral 14 denotes a thus-formed cap made of synthetic resin.

Figure 13:
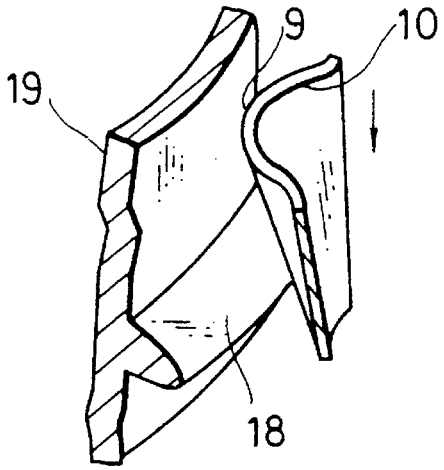
FIG. 13 is a view for explaining operation of the container opening/closing device according to the present invention.
Figure 14:
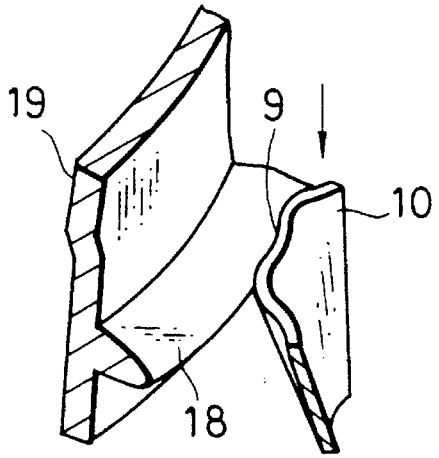
FIG. 14 is a view for explaining operation of a step subsequent to the step of FIG. 13.
Figure 15:
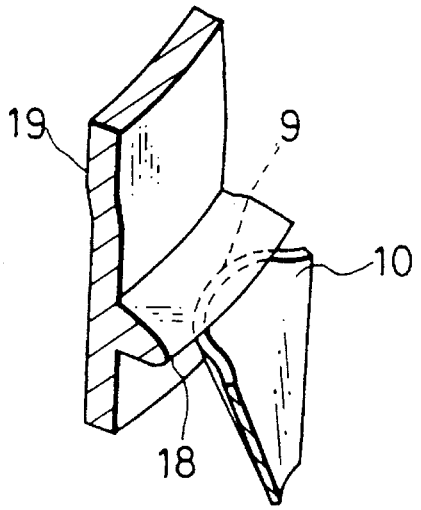
FIG. 15 is a view for explaining operation of a step subsequent to the step of FIG. 14.
Figure 16:
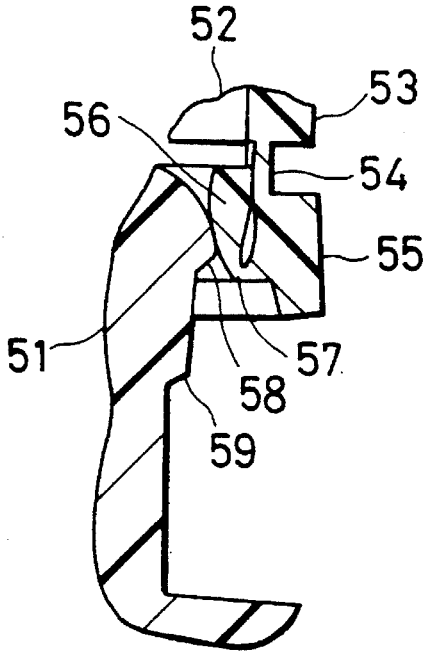
FIG.16 (PRIOR ART)
FIG. 16 is a partial sectional view of a prior art container opening/closing device of the type similar to the device of the present invention.
Figure 17:
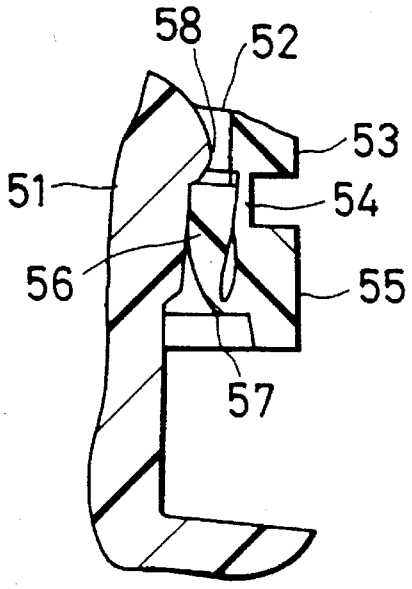
FIG.17 (PRIOR ART)
FIG. 17 is a sectional view for explaining a condition of the device shown in FIG. 16 subsequent to the condition of FIG. 16.

Referring to FIG. 1 again, denoted by 19 is a container for example, a bottle made of synthetic resin such as polypropylene. The container 19 has a mouth 15 having an outer circumferential surface 16 in which a screw-shaped groove 17 coming into mesh with the screw-shaped rib 2 on the cap is formed. An annular projection 18 is formed on the outer circumferential surface 16 of the mouth 15 below the screw-shaped groove 17. The projection 18 has a diameter larger than that defined by the upper edges of the engagement members 10. As shown in FIGS. 13 to 15, therefore, when the cap 14 is fitted over the mouth 15, the bulged portions 9 of the engagement members 10 are recessed or pushed back radially outward, allowing the engagement members 10 to ride over the projection 18 downward.

After riding downwardly over the projection 18, the engagement members 10 are allowed to bulge radially inward again upon restoration from its elastically deformed state so that the engagement members engage the projection 18 in the vertical direction.

Figure 6:
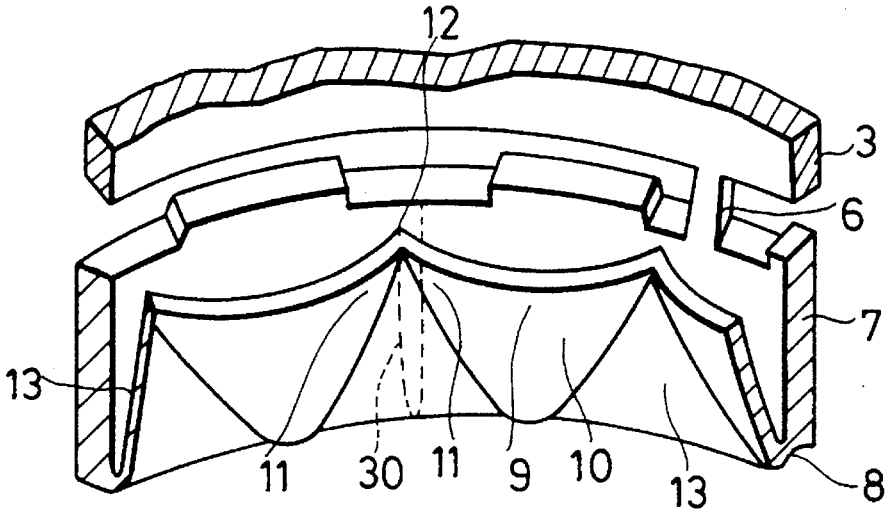
FIG. 6 is an enlarged perspective view of part of the cap of FIG. 2.

In FIGS. 2 and 6, denoted by 30 is an embrittled line formed to extend vertically across the ring 7, the thin film 13 and the engagement member 10. The embrittled line 30 may be formed to extend vertically across only the ring 7 and the engagement member 10. The embrittled line 30 can be formed by a groove, perforations, a slit, or a combination thereof. In the embodiment shown in FIG. 10, the embrittled line 30 is formed to extend vertically across only the ring 7 and the thin film 13.

Figure 4:
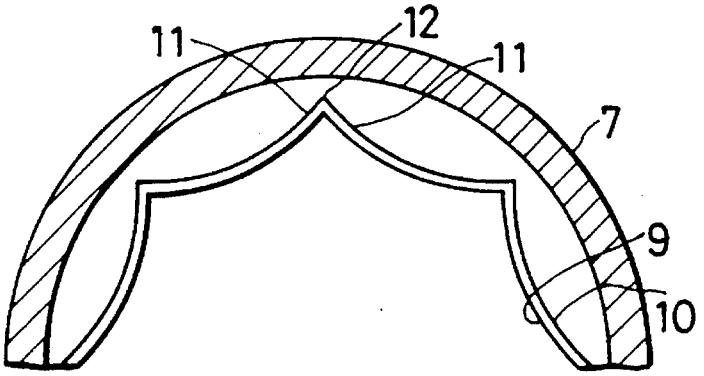
FIG. 4 is a partial sectional view taken along line 27—27 in FIG. 2.
Figure 5:
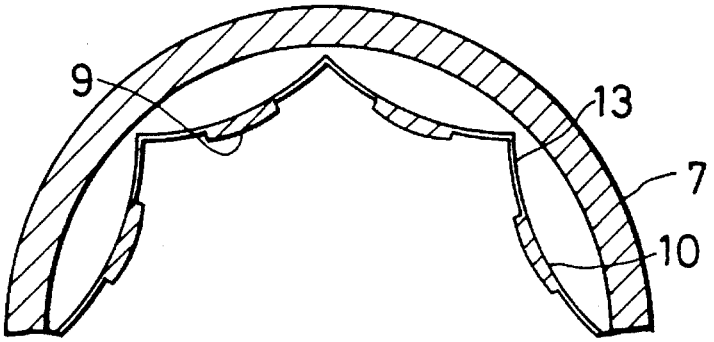
FIG. 5 is a partial sectional view taken along line 28—28 in FIG. 2.
Figure 7:
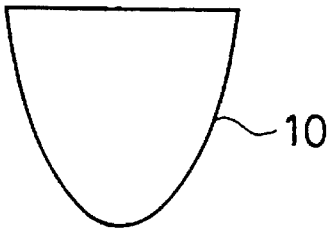
FIG. 7 is a front view of part of a cap of a container opening/closing device, the view showing another embodiment of the present invention.
Figure 8:
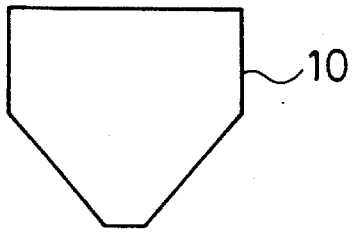
FIG. 8 is a view similar to FIG. 7, the view showing still another embodiment of the present invention.
Figure 9:
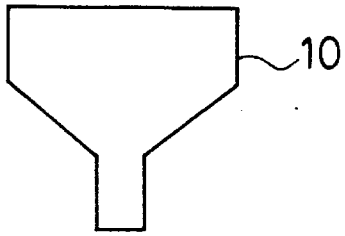
FIG. 9 is a view similar to FIG. 7, the view showing still another embodiment of the present invention.

FIG. 4 is a partial sectional view taken along line 27—27 in FIG. 2, and FIG. 5 is a partial sectional view taken along line 28—28 in FIG. 2. The engagement member 10 may have any of other various shapes such as shown in FIGS. 7 to 9 than the substantially inverted-triangular shape shown in FIG. 2.

Figure 10:
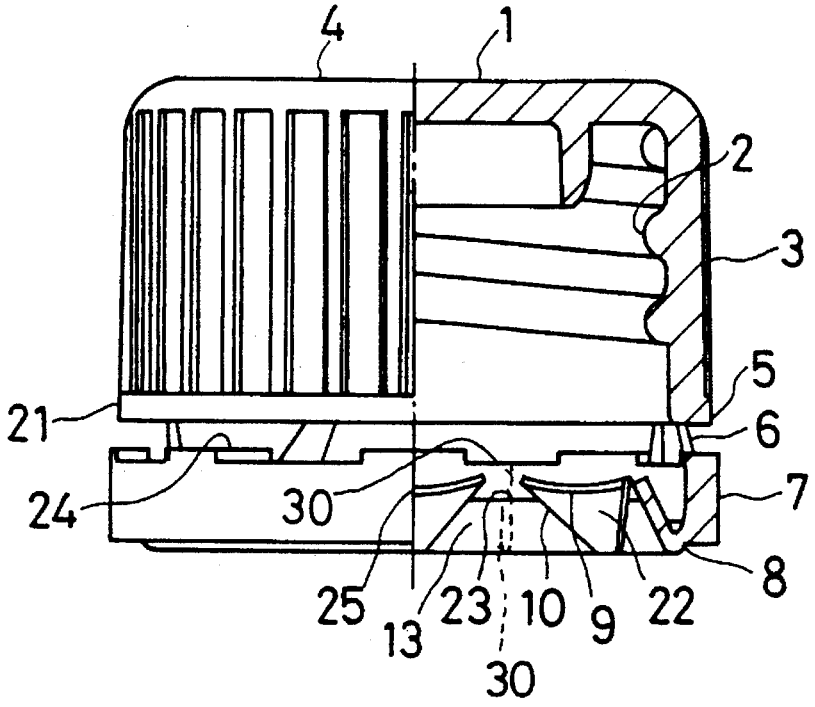
FIG. 10 is a view, partly in section, of a cap of a container opening/closing device, the view showing still another embodiment of the present invention.
Figure 11:
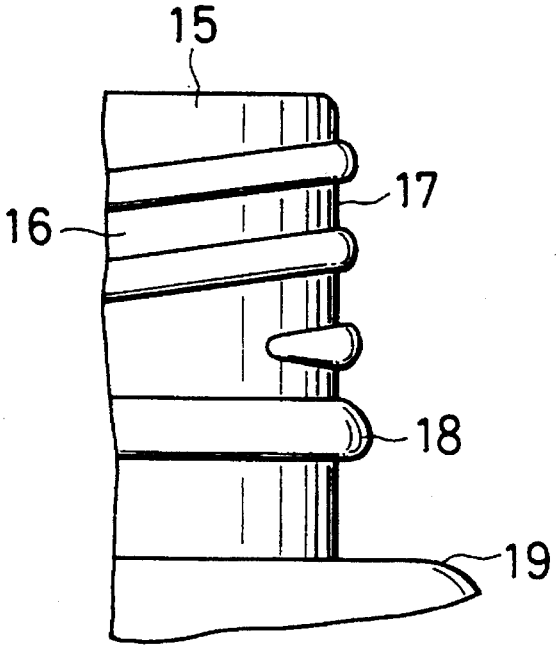
FIG. 11 is a partial view of a container of the container opening/closing device, the view showing an embodiment of the present invention.
Figure 12:
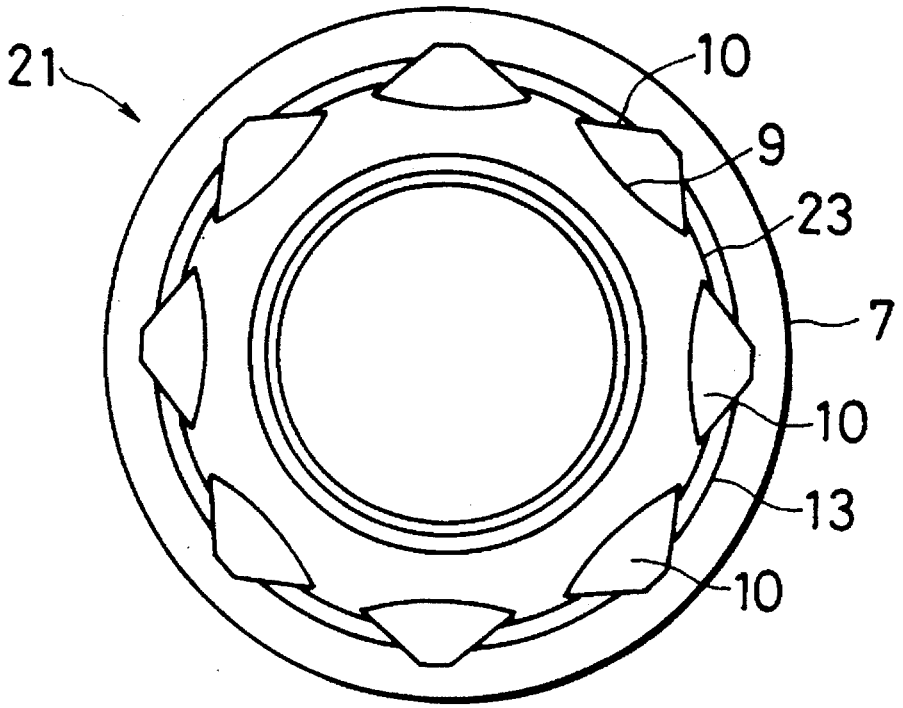
FIG. 12 is a bottom view of the cap shown in FIG. 10.

FIGS. 10 to 12 show another embodiment of the present invention. This embodiment is basically of the same arrangement as the above embodiment shown in FIGS. 1 to 5 except that, as seen from FIGS. 10 to 12, the upper side ends of the adjacent engagement members 10 of a cap 21 are not connected to each other, but are independently joined to the ring 7, and the thin films 13 are each truncated as indicated by 23 at its upper end.

In FIGS. 1, 2 and 10, denoted by 24 is a projection formed on an upper end of the ring 7. When the cap 14 is fitted over the mouth 15 of the container 19, the projections 24 are brought into contact with the lower end of the tubular member 3 of the cap body 4 at the time the engagement members 10 ride over the projection 18 downward, thereby preventing the joint pieces 6 from being damaged.

In the embodiment, when the cap 14 or 21 is fitted over the mouth 15 of the container 19, the engagement members 10 bulging inward so as to have the arc-shaped upper edges are elastically deformed by the projection 18 and are recessed or pushed back radially outward to be able to ride downwardly over the projection 18. At this time, the engagement members 10 are smoothly and positively depressed because they are pushed back radially outward starting from central areas 25 of the arc-shaped bulged portions 9 gradually toward both sides thereof along the inner circumference of the ring 7 and also starting from lower ends of the bulged portions 9 gradually toward their upper ends. When the engagement members 10 come into the side below the projection 18 after having completely ridden over it, they are allowed to bulge radially inward into the original arc-shape again upon restoration from its elastically deformed state so that the central areas 25 of the engagement members can deeply enter under the projection 18. Accordingly, there is no fear that the engagement members 10 may disengage from, or ride over, the projection 18 upward when the cap 14 is unscrewed to remove it. If the cap 14 is unscrewed by any person other than the genuine consumer, the ring 7 cannot move up owing to the tight engagement with the projection 18 and the joint pieces 6 are torn, indicating that the container has been cheatingly opened.

When the genuine consumer unscrews the cap, the engagement members 10 are not disengaged from the projection 18 because they are bulged radially inward in the arc-shape and are held in tight engagement with the projection 18 from below. Also, since the bulged portions 9 have the arc-shape which provides a high degree of compression strength in the vertical direction, the engagement members 10 exhibit a very small vertical elastic deformation. Therefore, when the cap body 4 is moved upward and the joint pieces 6 are subject to tension load, the joint pieces 6 can be immediately torn in a snap without making the consumer feel embarrassed or unpleasant unlike the above-described prior art in which the bridge 54 will not easily tear because of a vertical elastic deformation of the stop ring 56.

With the container opening/closing device arranged as described above, if the cap 14 is cheatingly unscrewed under the condition where the cap 14 is fitted over the mouth 15 of the container 19, the joint pieces 6 are torn, indicating that the container has been cheatingly opened.

Since the engagement members 10 of the cap 14 are formed as described above, the bulged portions 9 are depressed radially outward to provide such a degree of pliability, when the cap 14 is fitted over the container mouth 15, that the engagement members can smoothly and effectively ride the projection 18 downward. On the other hand, when the genuine consumer unscrews the cap 14, since the engagement members 10 exhibit a high degree of compression strength in the vertical direction with the presence of the arc-shaped bulged portions 9, the joint pieces 6 can be immediately torn in a snap almost the same as when the cap is unscrewed, without any discomfort unlike the above-described prior art in which the bridge 54 will not easily tear because of pliability of the stop ring 56.

Stated otherwise, a container opening/closing device can be provided which has the engagement members 10 capable of exhibiting both pliability and rigidity, i.e., the contradictory requirements that have not been solved in the prior art.

The engagement members 10 are first formed to extend obliquely downward by molding, and are thereafter inverted or folded back to extend obliquely upward. But since the engagement members 10 are each inclined along both parallel sides thereof so as to spread toward the upper end and only the thin film 13 is formed between the adjacent engagement members 10. The engagement members 10 can be folded back by a smaller force than is required for folding back the corresponding components in the prior art.

Further, since the engagement members 10 have the bulged portions 9 projecting radially inward, even if there occur variations in size of the mouth 15 of the container 19 or the cap 14 during manufacture, the engagement members 10 can accommodate the variations so that the cap can be fitted to the container mouth.

Additionally, after removing the cap body 4, the ring 7 including the engagement members 10 is left around the mouth 15 of the container 19. However, the ring 7 can be removed from the mouth 15 of the container 19 by tearing it at the embrittled line 30. This solves the problem that the mouth 15 of the container 19 is aesthetically worsened in its appearance.

What is claimed is:

1. For use with a container having a mouth containing a screw thread on an external surface thereof and an annular projection for engaging engagement members of a container opening/closing device, a container opening/closing device, comprising:

a cap made of synthetic resin having a top wall and a tubular member formed integrally with said top wall and containing a screw thread on an inner circumferential surface thereof cooperable with the screw thread on said mouth, a ring integrally connected to a lower end of said tubular member by means of frangible joint pieces, a plurality of engagement members spaced concentrically about said ring and being reversely offset at one end from a lower end of said ring to extend upwardly in the direction of said tubular member, said engagement members each having a substantially uniform thickness and being defined by laterally spaced sides which diverge in an upward direction to define an upper free end which is broader than said one end and which projects radially inwardly to provide an arc-shaped bulged portion for engagement with the annular projection of said container mouth; and thin films having a substantially uniform thickness less than the thickness of said engagement members, said thin films being alternately positioned between, and connecting with, adjacent engagement members, each of said films extending at their lower ends from the lower end of said ring and laterally between the sides of adjacent engagement members, whereby said films have a lower end that is broader than the lower ends of said engagement members and sides that are convergent in the direction of said tubular member.

2. A container opening/closing device according to claim 1 including a frangible embrittled line extending continuously vertically across said ring and said engagement member.

3. A container opening/closing device according to claim 1 including a frangible embrittled line extending continuously vertically across said ring, said thin film and said engagement member.

4. A container opening/closing device according to claim 1, including a frangible embrittled line extending continuously vertically across said ring and said thin film.

* * * * *